US007036569B2

(12) United States Patent
Kroetsch et al.

(10) Patent No.: US 7,036,569 B2
(45) Date of Patent: May 2, 2006

(54) END CAP WITH INTEGRAL PARTIAL REINFORCEMENT

(75) Inventors: Karl Paul Kroetsch, Williamsville, NY (US); David A. Southwick, Lockport, NY (US); David W Patterson, Wilson, NY (US)

(73) Assignee: Delphi Technologies, Inc., Troy, MI (US)

( * ) Notice: Subject to any disclaimer, the term of this patent is extended or adjusted under 35 U.S.C. 154(b) by 149 days.

(21) Appl. No.: 10/696,103

(22) Filed: Oct. 29, 2003

(65) Prior Publication Data

US 2005/0092461 A1 May 5, 2005

(51) Int. Cl.
*F28D 1/00* (2006.01)

(52) U.S. Cl. ..... 165/149; 165/153

(58) Field of Classification Search ..... 165/67, 165/149, 152, 153, DIG. 480; 29/890.03, 29/890.052, 890.054
See application file for complete search history.

(56) References Cited

U.S. PATENT DOCUMENTS

| | | | | |
|---|---|---|---|---|
| 5,000,257 | A * | 3/1991 | Shinmura | 165/67 |
| 5,127,466 | A * | 7/1992 | Ando | 165/67 |
| 5,535,819 | A * | 7/1996 | Matsuura | 165/149 |
| 5,622,220 | A * | 4/1997 | Park et al. | 165/153 |
| 5,975,197 | A * | 11/1999 | Kado | 165/149 |
| 6,189,603 | B1 * | 2/2001 | Sugimoto et al. | 165/140 |
| 6,293,334 | B1 * | 9/2001 | Ghiani | 165/149 |
| 6,357,519 | B1 | 3/2002 | Ozaki et al. | 165/140 |
| 6,478,080 | B1 * | 11/2002 | Pinto | 165/153 |
| 6,837,304 | B1 * | 1/2005 | Makino et al. | 165/152 |
| 2002/0056541 | A1 | 5/2002 | Kokubunji et al. | 165/67 |
| 2002/0084064 | A1 * | 7/2002 | Rhodes et al. | 165/149 |
| 2004/0069468 | A1 * | 4/2004 | Lamich et al. | 165/149 |
| 2005/0109492 | A1 * | 5/2005 | Kroetsch et al. | 165/149 |
| 2005/0150641 | A1 * | 7/2005 | Calhoun et al. | 165/149 |

FOREIGN PATENT DOCUMENTS

DE 10132153 * 1/2003

* cited by examiner

*Primary Examiner*—Teresa J. Walberg
(74) *Attorney, Agent, or Firm*—Patrick M. Griffin

(57) ABSTRACT

A metal tank cap is integral with a reinforcing member via a narrow connection and covers an open end of the tank with adjacent reinforcement members being spaced from one another along each side of the core. The reinforcing members each have a pair of flanges extending outwardly from the sides thereof and have openings therein for receiving mounting anchors.

7 Claims, 4 Drawing Sheets

END CAP WITH INTEGRAL PARTIAL REINFORCEMENT

BACKGROUND OF THE INVENTION

1. Field of the Invention

The subject invention relates to a heat exchanger assembly of the type having a tank at each end of a core with the tanks having open ends that are closed by caps.

2. Description of the Related Art

Such prior art assemblies fabricate independent caps for closing the ends of the tanks thereby requiring separate and independent fabrication of caps as well as separate handling and assembly of the caps to the tanks. The independent caps may be connected to the side reinforcing members but such a process requires four independent caps and two reinforcement members. The end caps close the open ends of the tanks and are independently connected to a reinforcement member extending along the side of the core. In some assemblies the caps are extrusions of the reinforcement members or are stamped together, as illustrated in U.S. Pat. No. 6,357,519 to Ozaki et al.

BRIEF SUMMARY OF THE INVENTION AND ADVANTAGES

The invention provides a method of fabricating a heat exchanger assembly having a core with fins and tubes extending from opposite ends and into openings in tanks at each end of the core and tank caps closing open ends of the tanks. The method includes forming a reinforcement member integrally with a tank cap via a connection portion with reinforcing flanges extending upwardly from the edges of the reinforcement members and terminating short of the connection portion. A tank cap is placed over each open end of the tank with the reinforcement members connected to the tank caps extending partially along the sides of the core and spaced from one another along the sides of the core whereby the core is devoid of reinforcement between the reinforcement members.

Accordingly, the metal components may be pre-assembled and inserted into a furnace where they are brazed together instead of being mechanically connected together as by crimping at the joint between the core and the tanks, which results in a protrusion from the side of the assemblies. The tank end cap integral with a partial reinforcement member reduces cost and weight. The concept of an integral partial reinforcement member and tank cap is practical for applications with narrow welded tubes (less than 20 mm and low hoop stress) and mechanically folded tubes. The partial core reinforcement is only needed to support the corner tube to header or tank joints to resist thermal and pressure cycle fatigue. The partial reinforcement can also be used to mount external components.

BRIEF DESCRIPTION OF THE SEVERAL VIEWS OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
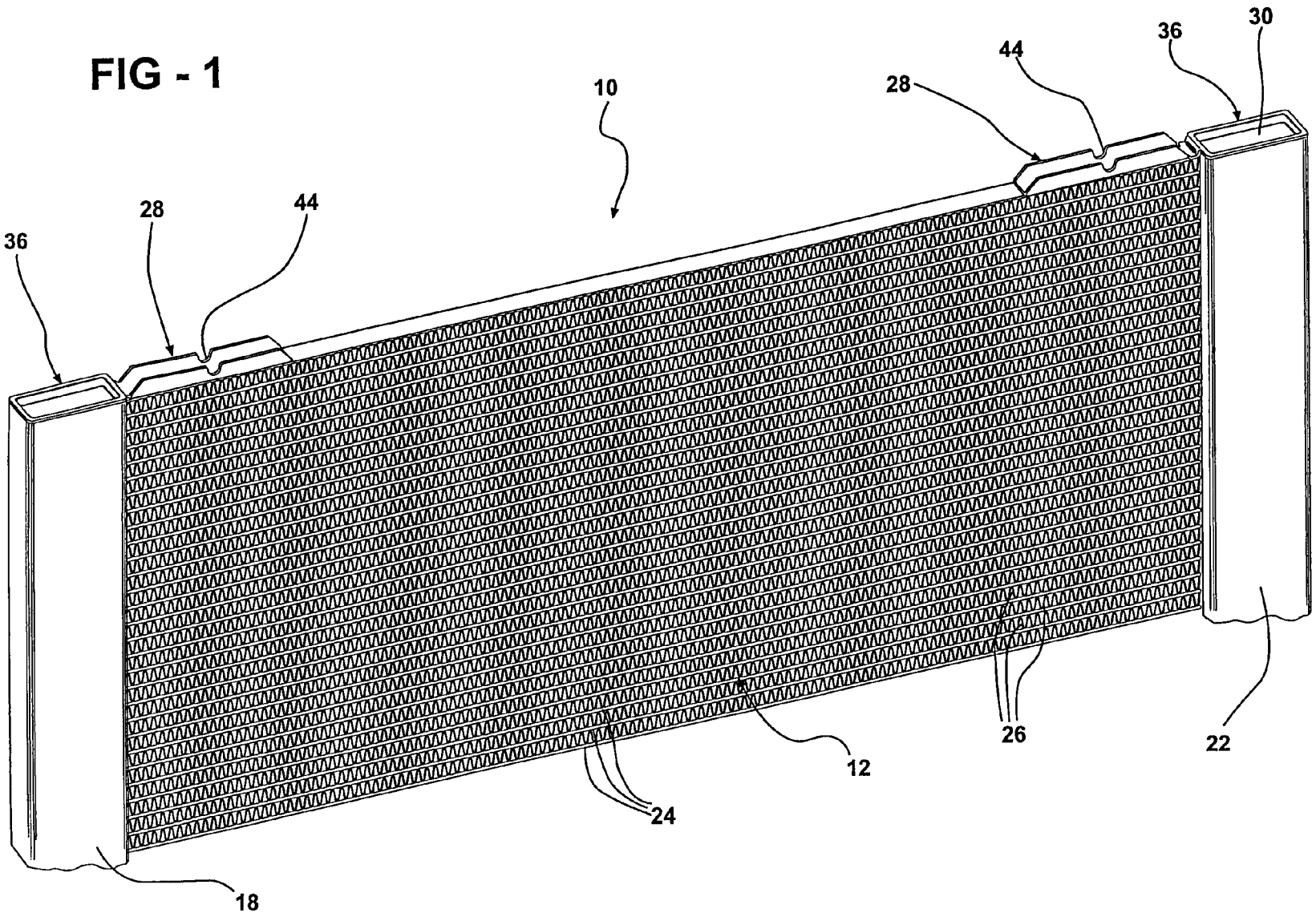
FIG. 1 is a perspective view of an heat exchanger constructed in accordance with the subject invention.

Referring to the Figures, wherein like numerals indicate like or corresponding parts throughout the several views, a heat exchanger assembly constructed in accordance with the subject invention is generally shown at 10.

The heat exchanger assembly 10 includes a heat exchanger core, generally indicated at 12, for exchanging heat with a fluid flowing between the ends thereof. A first tank 18 is disposed at a first end of the core 12 and a second tank 22 is disposed at the second end of the core 12 for fluid flow through the heat exchanger core 12 between the tanks 18 and 22. The core 12 includes tubes 24 with heat exchanger fins 26 extending between the tubes 24, the tubes 24 extending from opposite ends between opposite sides thereof, as is well known in the art. The ends of the tubes 24 are inserted into openings or slots in the respective tanks 18 and 22 for fluid flow between the tanks. In other words, the first 18 and second 22 tanks are disposed at the opposite ends of the core 12 and are in fluid tight communication with the tubes 24. The tanks 18 and 22 extend between open ends 30. In addition, reinforcing members, generally indicated at 28, extend partially along the opposite sides of the core 12, i.e., from the ends toward the middle. The tanks 18 and 22 also include nozzles or pipes (not shown) to act as an inlet and an outlet to convey fluid into and out of the tanks 18 and 22.

Figure 3:
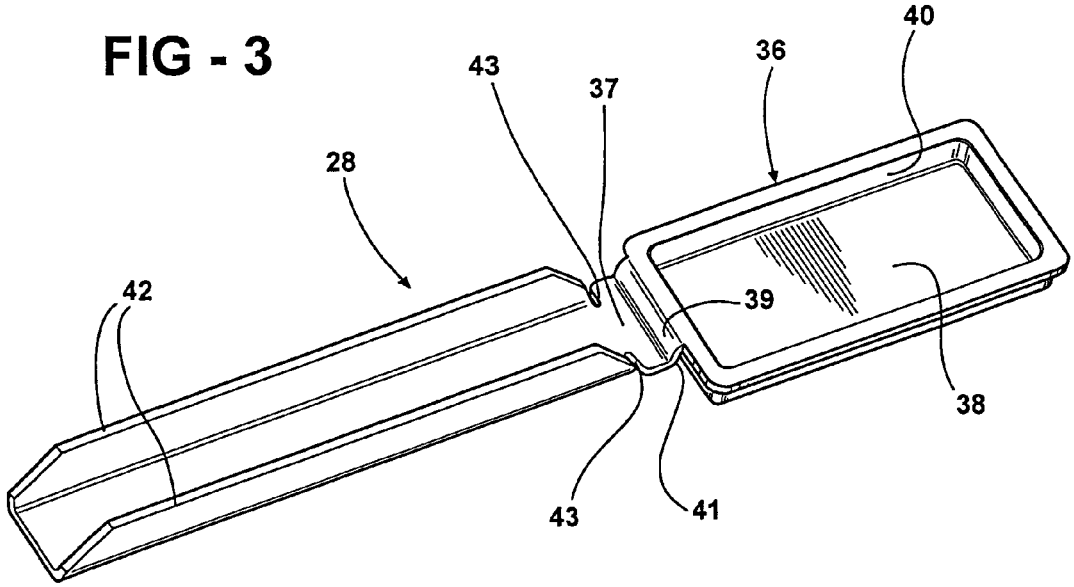
FIG. 3 is a perspective view showing the tank cap and integral reinforcing member from the top thereof.
Figure 4:
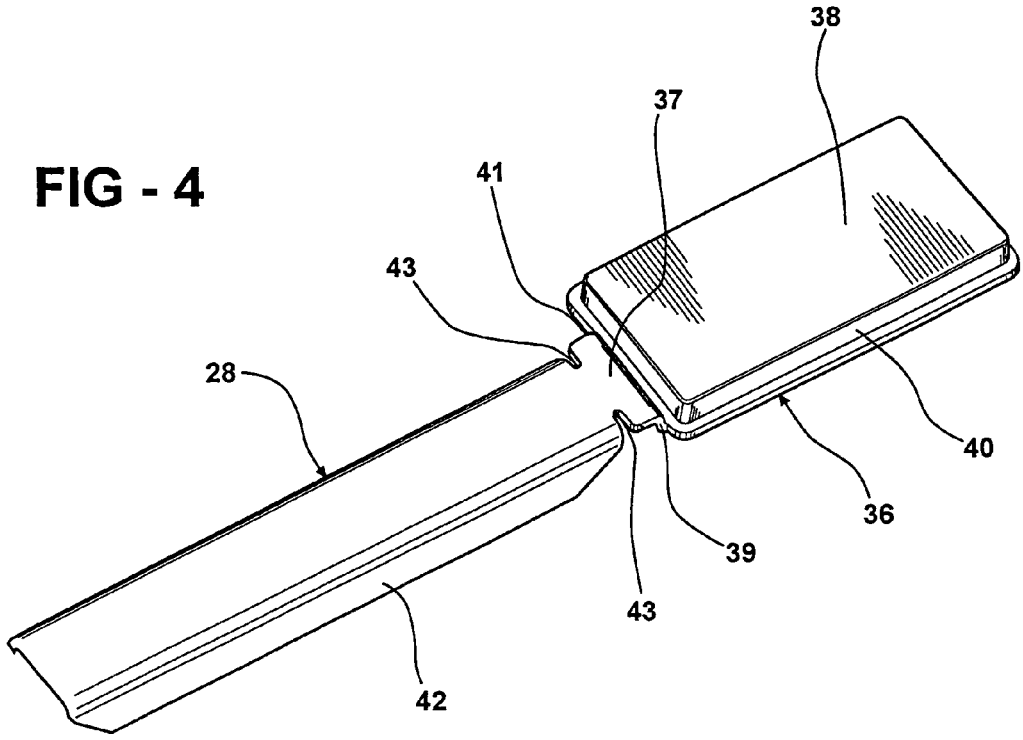
FIG. 4 is a perspective view like FIG. 3 but showing the bottom of the tank cap and integral reinforcing member.

The heat exchanger assembly 10 includes a plurality of tank caps, each generally indicated at 36, closing the open ends 30 of the tanks 18, 22. However, in accordance with the subject invention, each reinforcing member 28 and the adjacent tank cap 36 are one integral member. More specifically, each reinforcing member 28 and one of the integral tank caps 36 consist of one homogenous material, namely a metal such as aluminum. Each tank cap 36 is integral with each reinforcing member 28 via a homogenous s-shaped connector 37 having reverse bends 39 and 41. The tank caps 36 are configured for closing the opposite open ends 30 of both tanks 18 and 22 at opposite ends of the core 12. The connectors 37 may also contain a notch 43 to further facilitate the bending between the tank cap 36 and the integral reinforcement member 28 and provide a thermal stress relief area. The connectors 37 are of a smaller or more narrow width than either the integral tank cap 36 or the integral reinforcement member 28 to facilitate bending as the tank cap and reinforcement member are pressed into engagement with the tanks 18 or 22 and the sides of the core 12. As illustrated in FIG. 3, each tank cap 36 is disposed in engagement with the open end of the tank 18 or 22. More specifically, each tank cap 36 has a dished configuration with a bottom 38 and sidewalls 40 engaging the interior of the open end 30 of each tank 18 or 22. The reinforcing members 28, the tank caps 36, and the tubes 24 consist of metal and are brazed or otherwise welded together.

Figure 2:
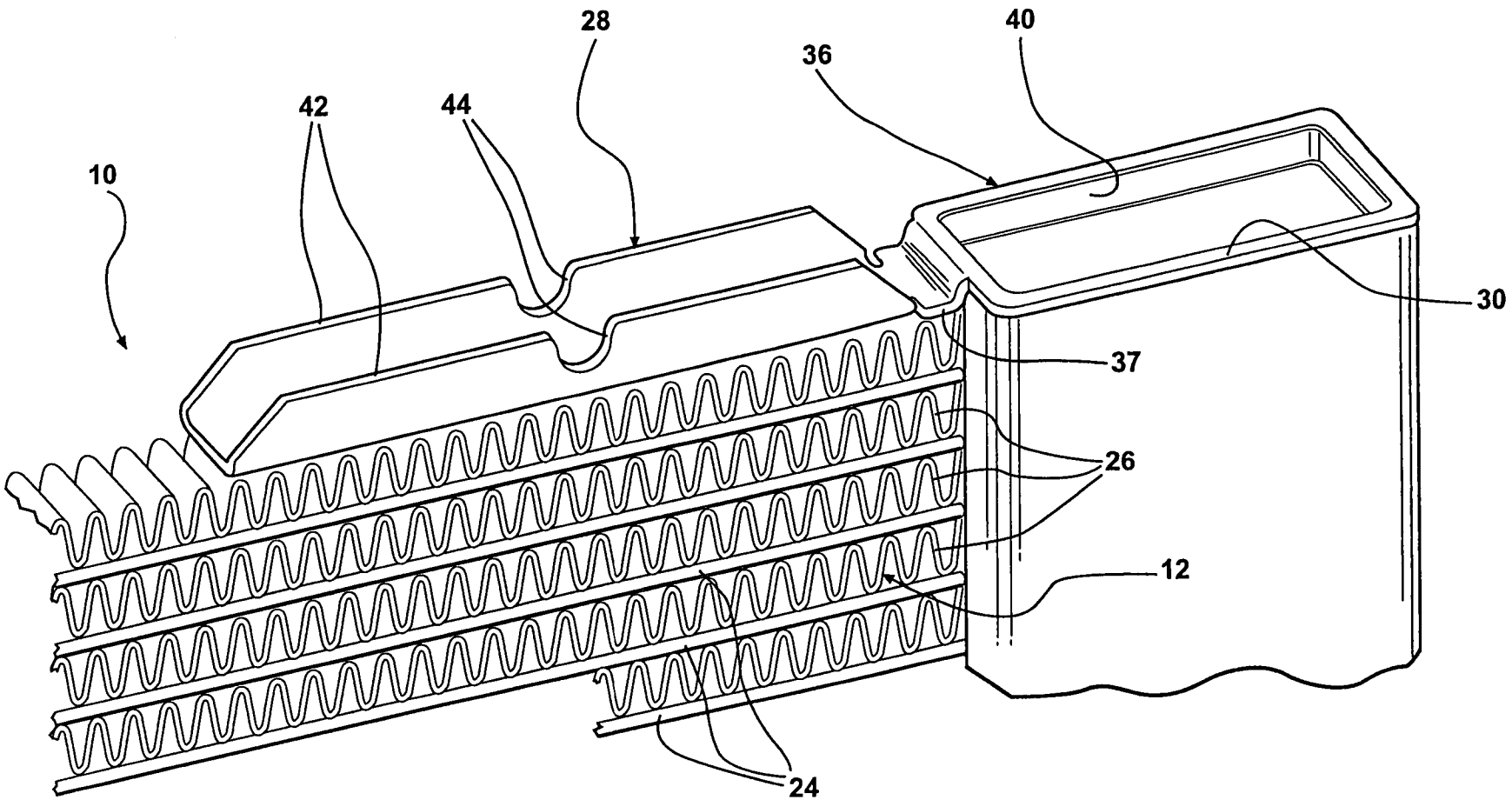
FIG. 2 is a fragmentary perspective view showing one corner of the heat exchanger.

Each reinforcement member 28 is connected to one tank cap 36 and extends along the side of the core 12 with the reinforcement members 28 on each side of the core 12 being spaced from one another longitudinally along the side of the core 12 whereby the core 12 is devoid of reinforcement longitudinally between the reinforcement members 28. In fact, the reinforcement members 28 are placed into direct engagement with the fins 26 of the core 12, as best illustrated in FIG. 2.

Figure 5:
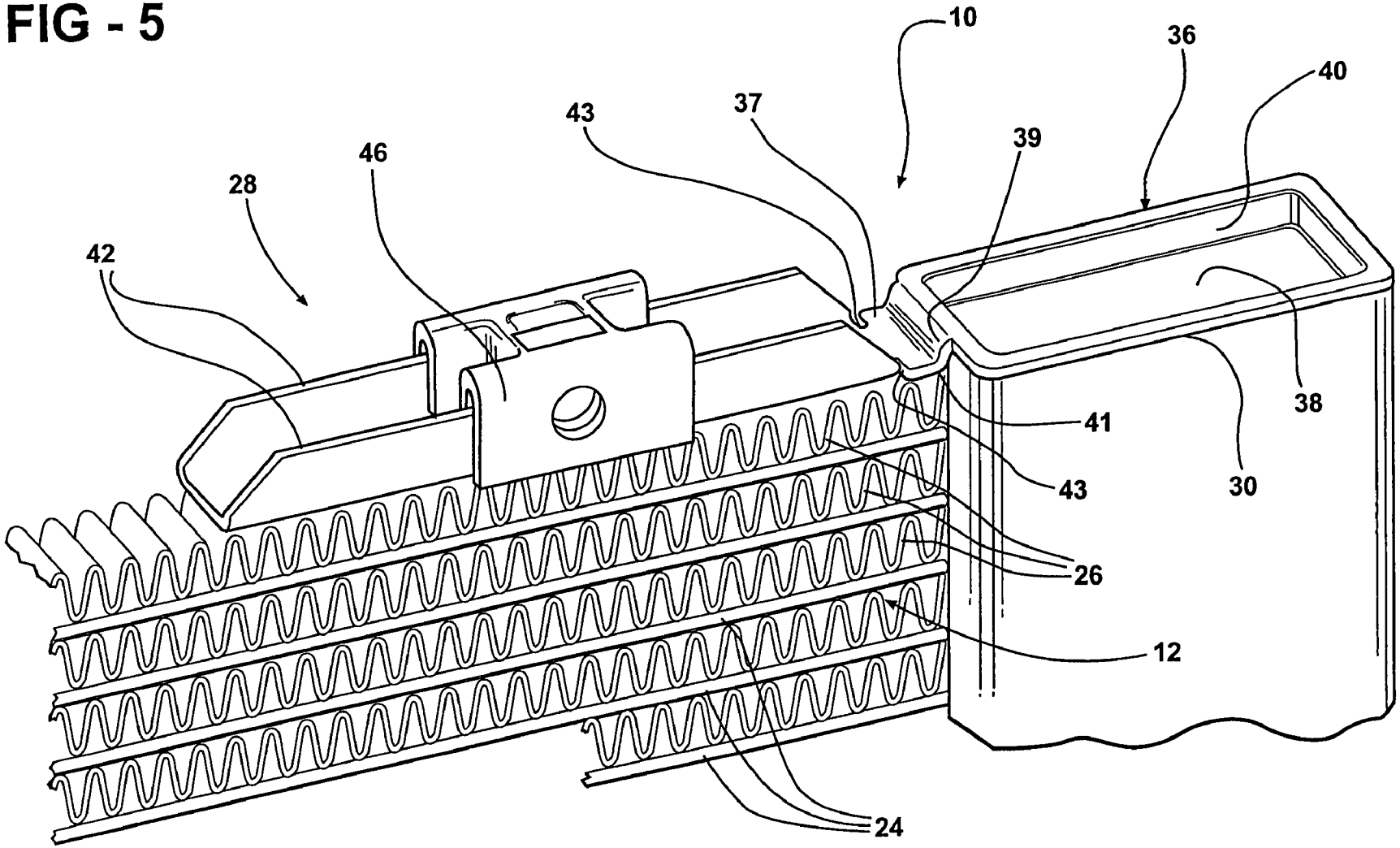
FIG. 5 is fragmentary perspective view of the corner of the heat exchanger with a mounting anchor attached to the reinforcing member.

Each reinforcement member 28 includes a pair of reinforcing flanges 42 extending upwardly from the edges of the reinforcement members 28 and terminate at inwardly inclined ends short of the connection portion 37. The flanges 42 extend in the opposite direction from the direction in which the side walls 40 extend to the bottom 38 of each tank cap 36. In addition, the flanges 42 of the reinforcing members 28 define openings 44 therein and, as shown in FIG. 5, an anchor 46 is attached to the flanges 42 in the openings 44 therein.

As will be appreciated, the invention provides a method of fabricating a heat exchanger assembly 10 having a core 12 with fins 26 and tubes 24 extending from opposite ends and into openings or slots in tanks 18 or 22 at each end of the core 12 and reinforcement members 28 extending along opposite sides of the core 12 with tank caps 36 closing open ends 30 of the tanks 18 or 22, wherein a pair of reinforcement members 28 are each formed integrally with a tank cap 36, by a connection portion 37. In order to facilitate the closure of the open ends 30 of the tanks 18 and 22, each tank cap 36 is formed with a dished configuration having a bottom 38 for disposition in the open end 30 of the tank 18 and 22 and side walls 40 for engaging the interior of the tank 18 and 22 for being brazed thereto. As each tank cap 36 is placed over an open end 30 of a tank 18 or 22, the integrally connected reinforcement member 28 is placed into engagement with the fins 26 to extend along the side of the core 12 in spaced relationship from another reinforcement member 28 along the side of the core 12 whereby the core 12 is devoid of reinforcement between the longitudinally spaced reinforcement members 28.

The method may include forming openings 44 in the flanges 42 of the reinforcing members 28 and attaching an anchor 46 to the flanges 42 in the openings 44 thereof, as with bolts extending through the anchors 46 and the openings 44.

Obviously, many modifications and variations of the present invention are possible in light of the above teachings. The invention may be practiced otherwise than as specifically described within the scope of the appended claims.

What is claimed is:

1. A heat exchanger assembly comprising;

a core with fins and tubes extending from opposite ends between opposite sides thereof, first and second tanks at said opposite ends of said core and in fluid tight communication with said tubes and extending between open ends, a plurality of tank caps closing said open ends of said tanks, a reinforcement member integrally connected to each of said tank caps by an integral connection portion with the separate and independent reinforcement member connected to said tank caps extending along the sides of the core and spaced from one another along the sides of the core whereby the core is devoid of reinforcement between the reinforcement between the separate reinforcement members, reinforcing flanges extending upwardly from the edges of said reinforcement members and terminating short of said connection portion, each of said open ends of said tank having an endless periphery, said tank cap having a dished configuration with a bottom and sidewalls completely surrounding said bottom and engaging the encompassing the entire interior of said endless periphery of the associated open end of said tank, and said connection portion comprising reverse bends defining an S-shape more narrow in width than said tank cap integral therewith with one of said bends being connected to said tank cap at one of said sidewalls above said bottom thereof and the other of said bends being connected to and aligned with said reinforcement member integral therewith, said connection portion having notches extending there into.

2. An assembly as set forth in claim 1 wherein said reinforcing member and said integral tank cap consist of one homogenous material.

3. An assembly as set forth in claim 2 wherein said homogenous material is metal.

4. An assembly as set forth in claim 1 wherein said reinforcing members, said tank caps, and said tubes consist of metal and are brazed together.

5. An assembly as set forth in claim 1 including said reinforcement members being in direct engagement with said fins of said core.

6. An assembly as set forth in claim 1 wherein said flanges of said reinforcing members define openings therein.

7. An assembly as set forth in claim 6 including an anchor attached to said flanges in said openings therein.

* * * * *